US009034108B2

(12) United States Patent
Geissler et al.

(10) Patent No.: US 9,034,108 B2
(45) Date of Patent: May 19, 2015

(54) CLEANING COMPOSITIONS FOR USE IN CLOSED LOOP CLEANING MACHINES

(75) Inventors: Konrad Geissler, Zurich (CH); Marius Kuemin, Huenenberg (CH)

(73) Assignee: Dow Global Technologies LLC, Midland, MI (US)

( * ) Notice: Subject to any disclaimer, the term of this patent is extended or adjusted under 35 U.S.C. 154(b) by 1033 days.

(21) Appl. No.: 12/736,446

(22) PCT Filed: Feb. 27, 2009

(86) PCT No.: PCT/US2009/001263

§ 371 (c)(1),
(2), (4) Date: Dec. 6, 2010

(87) PCT Pub. No.: WO2009/126195

PCT Pub. Date: Oct. 15, 2009

(65) Prior Publication Data

US 2011/0088722 A1 Apr. 21, 2011

Related U.S. Application Data

(60) Provisional application No. 61/123,538, filed on Apr. 9, 2008.

(51) Int. Cl.
*B08B 3/08* (2006.01)
*B08B 3/14* (2006.01)
(Continued)

(52) U.S. Cl.
CPC ... *B08B 3/08* (2013.01); *B08B 3/14* (2013.01); *C11D 7/263* (2013.01); *C11D 7/5022* (2013.01); *D06F 43/007* (2013.01); *D06L 1/02* (2013.01); *D06L 1/10* (2013.01)

(58) Field of Classification Search
None
See application file for complete search history.

(56) References Cited

U.S. PATENT DOCUMENTS 5,693,149 A * 12/1997 Passer et al. ..... 134/26
5,711,819 A * 1/1998 Miyasaki ..... 134/11
(Continued)

FOREIGN PATENT DOCUMENTS

| | | | |
|---|---|---|---|
| DE | 19609119 | | 9/1997 |
| JP | 06-220670 | * | 8/1994 |
| JP | 06220670 | | 8/1994 |

OTHER PUBLICATIONS

Computer translation of JP06-220670 by Kawauchi et al., published Aug. 9, 1994.*
(Continued)

*Primary Examiner* — Michael Kornakov
*Assistant Examiner* — Ryan Coleman
(74) *Attorney, Agent, or Firm* — Brooks, Cameron & Huebsch, PLLC

(57) ABSTRACT

Embodiments of the present disclosure include cleaning processes, closed loop cleaning machines, and methods of cleaning an article. The cleaning process includes contacting a surface of an article with a cleaning composition in a cleaning chamber, where the cleaning composition includes at least about 85 percent by weight organic solvents, based on total weight of the cleaning composition, and where at least about 5 percent by weight of the organic solvents is propylene glycol, based on total weight of the organic solvents, to clean the surface of the article, collecting the cleaning composition including contaminants, and recovering the cleaning composition via distillation, where a distillation apparatus removes the contaminants from the cleaning composition and is connected to the cleaning chamber by a process stream.

6 Claims, 1 Drawing Sheet

(51) Int. Cl.

| | |
|---|---|
| ***C11D 7/26*** | (2006.01) |
| ***C11D 7/50*** | (2006.01) |
| ***D06F 43/00*** | (2006.01) |
| ***D06L 1/02*** | (2006.01) |
| ***D06L 1/10*** | (2006.01) |

(56) References Cited

U.S. PATENT DOCUMENTS

| | | | | |
|---|---|---|---|---|
| 5,782,989 | A | 7/1998 | Rueter | |
| 5,968,848 | A | 10/1999 | Tanabe et al. | |
| 2002/0068685 | A1 | 6/2002 | Wojtczak et al. | |
| 2004/0048761 | A1 | 3/2004 | Ikemoto | |
| 2005/0091756 | A1 * | 5/2005 | Wright et al. | 8/137 |
| 2005/0223503 | A1 * | 10/2005 | Hong et al. | 8/158 |

OTHER PUBLICATIONS

International Search Report and Written Opinion for related PCT Application PCT/US2009/001263, dated June 22, 2009 (14 pgs).

Jones W. Lauder. "On Salts of Nitroparaffins . . . " American Chemical Journal. vol. XX No. 1. Jan. 1898 pp. 1-51, Kent Chemical Laboratory, University of Chicago.

* cited by examiner

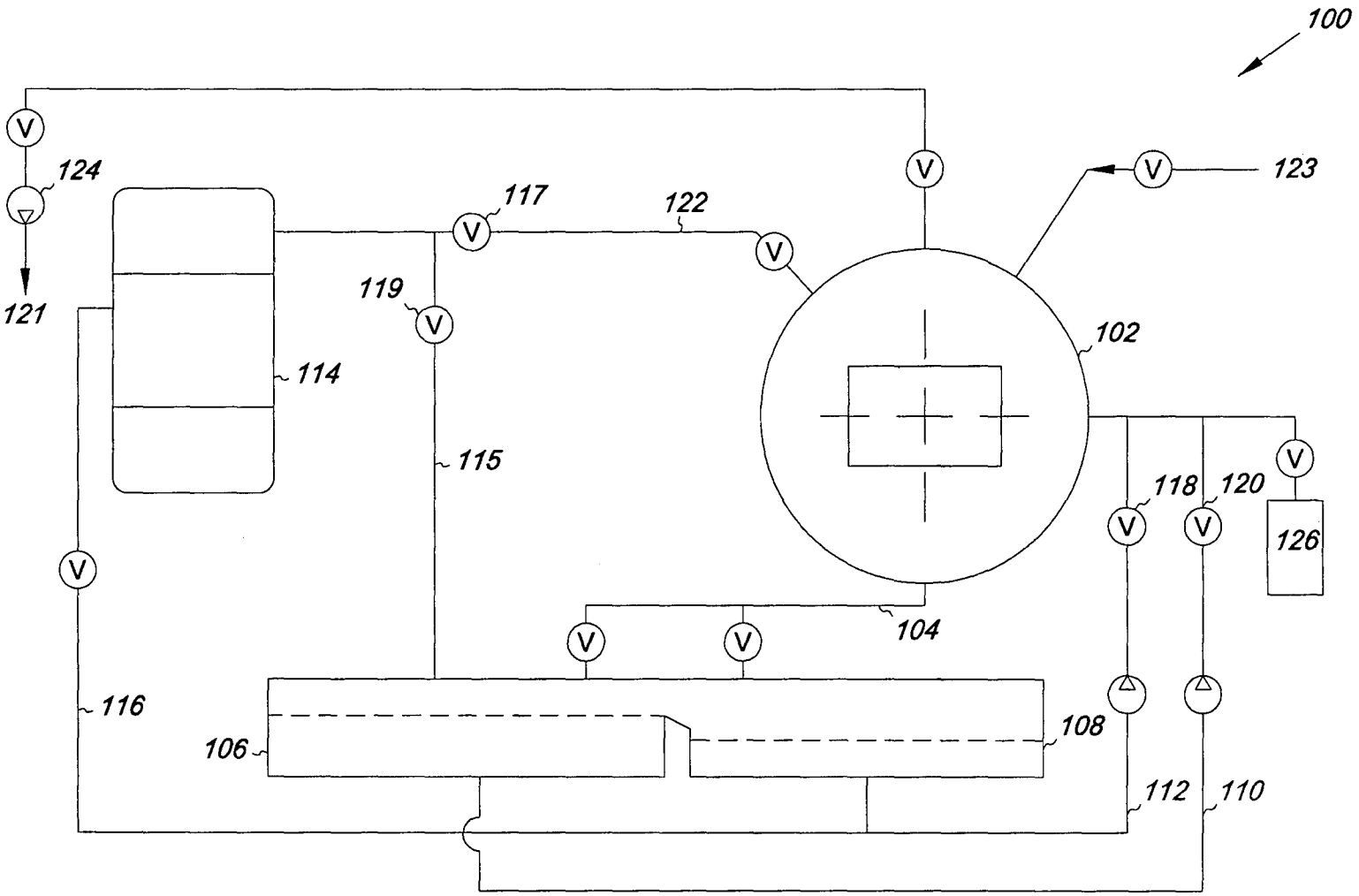
100
123
126
120
118
110
112
102
108
104
122
117
115
119
114
106
116
124
121

CLEANING COMPOSITIONS FOR USE IN CLOSED LOOP CLEANING MACHINES

This application is a National Stage application under 35 U.S.C. 371 of PCT/US2009/001263, filed on Feb. 27, 2009 and published as WO 2009/126195 on Oct. 15, 2009, which claims priority in part from U.S. Provisional Application Ser. No. 61/123,538 filed Apr. 9, 2008, the entire content of which is incorporated herein by reference.

FIELD OF DISCLOSURE

Embodiments of the present disclosure include cleaning compositions for use in closed-loop cleaning machines; more specifically, embodiments of the present disclosure include cleaning compositions including at least about 85 percent by weight organic solvents, based on total weight of the cleaning composition, where at least about 5 percent by weight of the organic solvents is propylene glycol, based on total weight of the organic solvents.

BACKGROUND

Examples of cleaning and degreasing methods which have been applied to metals, ceramics, plastics, and other materials in the past can include alkali cleaning, cleaning with a surface active agent, cleaning with chloro-solvent, and/or cleaning with a fluoro-solvent. Alkali cleaning is cleaning achieved by dipping the material into a warm aqueous or alcohol solution of sodium hydroxide or other alkali agent, or by spraying such a solution. Similarly, cleaning with a surface active agent can be achieved by dipping the material into a warm aqueous solution of a surface active agent, or by spraying such a solution. Cleaning with chloro-solvent involves dipping or vapor cleaning with a chloro-solvent, such as, for example, 1,1,1-trichloroethane, trichloroethylene, and/or perchloroethylene. Finally, cleaning with a fluoro-solvent involves dipping or vapor cleaning with, for example, Freon 113.

Currently, organic solvents used in cleaning processes for various materials include hydrocarbons, halogenated hydrocarbons, propylene glycol ethers, ethylene glycol ethers, esters, or mixtures thereof. These solvents are useful since they can be recycled within the process by distillation. However, the solvents listed also show a very low polarity compared to water. As a consequence, solubility and cleanability of very polar soils is limited. In order to clean the polar soils, cleaning processes have incorporated a separate aqueous cleaning step.

SUMMARY

Embodiments of the present disclosure include cleaning processes, machines, and methods for cleaning an article. As discussed herein, embodiments of the cleaning process include contacting a surface of an article with a cleaning composition in a cleaning chamber, where the cleaning composition includes at least about 85 percent by weight organic solvents, based on total weight of the cleaning composition, and where at least about 5 percent by weight of the organic solvents is propylene glycol, based on total weight of the organic solvents, to clean the surface of the article. The cleaning process also includes collecting the cleaning composition including contaminants and recovering the cleaning composition via distillation, where a distillation apparatus removes the contaminants from the cleaning composition and is connected to the cleaning chamber by a process stream.

In some embodiments, recovering the cleaning composition via distillation is a continuous process in the cleaning process. As used herein, a "continuous" process refers to the process where the distillation apparatus is connected to the closed chamber such that substantially all the cleaning composition collected from the closed chamber flows to the distillation apparatus continuously.

In some embodiments, recovering the cleaning composition via distillation is a semi-continuous process in the cleaning process. As used herein, a "semi-continuous" process refers to a batch-wise operated distillation unit that is connected to a feed reservoir, and which acts as a buffer for process streams that are produced continuously or batch-wise with a frequency different than the distillation process.

As used herein, "a," "an," "the," "at least one," and "one or more" are used interchangeably. The terms "comprises" and variations thereof do not have a limiting meaning where these terms appear in the description and claims. Thus, for example, a closed-loop cleaning machine that comprises "a" distillation apparatus can be interpreted to mean that the closed-loop cleaning machine includes "one or more" distillation apparatuses.

The term "and/or" means one or all of the listed elements.

Also herein, the recitations of numerical ranges by endpoints include all numbers subsumed within that range (e.g., 1 to 5 includes 1, 1.5, 2, 2.75, 3, 3.80, 4, 5, etc.).

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

BRIEF DESCRIPTION OF THE FIGURES

FIG. 1 illustrates a cleaning machine to perform a cleaning process, where an article can be cleaned according to embodiments of the present disclosure.

DETAILED DESCRIPTION

Embodiments of the present disclosure include cleaning processes, a closed loop cleaning machine, and a method of cleaning an article. For the sake of convenience, the follow description relates the cleaning of an "article" although the process of the present disclosure is not limited to the cleaning of one article but is equally useful for cleaning several articles. The cleaning process includes contacting a surface of an article with a cleaning composition in a cleaning chamber, where the cleaning composition includes at least 85 percent by weight organic solvents, based on total weight of the cleaning composition, and where at least 5 percent by weight of the organic solvents is propylene glycol, based on total weight of the organic solvents, to clean the surface of the article. The cleaning process also includes collecting the cleaning composition including contaminants and recovering the cleaning composition via distillation, where a distillation apparatus removes the contaminants from the cleaning composition and is connected to the cleaning chamber by a process stream.

As used herein, "contaminants" in the cleaning composition result from soils on the surface of the article to be cleaned that are dissolved by the cleaning composition. When the surface of the article is cleaned in embodiments of the present disclosure, the soils on the surface of the article are dissolved by the cleaning composition, and are thus removed as the cleaning composition is, for example, flushed from the surface of the article. As a result, the cleaning composition includes the contaminants after contacting the surface of the article.

In the FIGURE herein, as will be appreciated, elements shown in the embodiment herein can be added, exchanged, and/or eliminated so as to provide any number of additional embodiments of processes and/or systems. In addition, as will be appreciated the proportion and the relative scale of the elements provided in the FIGURE is intended to illustrate the embodiments of the present invention, and should not be taken in a limiting sense. The drawing is a schematic illustration of an embodiment of the apparatus of the present disclosure.

FIG. 1 illustrates a cleaning machine 100 to perform a cleaning process, where an article can be cleaned according to embodiments of the present disclosure. As shown, an article to be cleaned can be loaded into the cleaning chamber 102. The article can be loaded in a known manner, for example, the article can be placed into a container (e.g., a basket) if appropriate. Articles that can be provided to the cleaning chamber 102 include articles formed of metal, ceramic, glass, plastic, and/or other materials.

The cleaning chamber 102 can be an open chamber or a closed chamber. In embodiments where the article to be cleaned includes volatile contaminants, or soils, on the article surface, a closed cleaning chamber 102 can be used to reduce the likelihood that environmentally hazardous or toxic substances are released into the atmosphere. In addition, in embodiments where the cleaning composition, discussed further herein, contains environmentally hazardous or toxic substances, a closed cleaning chamber 102 can be included in the cleaning machine 100.

As will be appreciated by one skilled in the art, embodiments including a closed cleaning chamber 102 can employ the use of vacuum pumps for achieving a desired pressure reduction inside the closed cleaning chamber.

Inside the cleaning chamber 102, a surface of the article can be contacted with a cleaning composition to clean the surface of the article. There are several different methods in which the surface of the article can be contacted with the cleaning composition. For example, in some embodiments, the cleaning chamber 102 can be flooded with cleaning composition in order to immersion wash the surface of the article. In addition, embodiments of the present disclosure include spraying the cleaning composition in a liquid phase onto the surface of the article in order to clean the surface of the article. Spraying subjects the surface of the article to a solvent-flushing action as it flows downward. The liquid drops can be collected, and the process can be continued until the article has a clean surface.

Embodiments of the present disclosure also include vaporizing the cleaning composition and providing the cleaning composition vapor to the cleaning chamber 102. In such embodiments, the surface of the article can have a lower temperature than the vapor, therefore, vapor can condense on the article and subject its surface to a cleaning composition flushing action as it flows downward. In such embodiments, the surface of the article is continually rinsed with condensed vapor until the surface of the article has the same temperature of the vapor and condensation ceases. The continuous rinsing with the vapor can also be stopped before the article has the same temperature of the vapor. Very effective cleaning of the surface of the article can be achieved.

In some embodiments, immersion washing, liquid spraying, and vapor degreasing can be performed sequentially on each article provided in the cleaning chamber 102. Embodiments also include performing one method of contacting the article with the cleaning composition, as well as different combinations of each method. For example, in some embodiments, the cleaning process can include spraying the article with the cleaning composition, followed by a vapor degreasing step, as described herein. The vapor degreasing step can be a beneficial second step in the cleaning process since the vapors remain substantially free of the contaminants, or soils, after being revaporized and sent back to the cleaning chamber 102. Also, the use of elevated temperatures can accelerate the rate of soil dissolution into the cleaning composition.

In some embodiments, the methods of contacting the article with the cleaning composition can depend on the article. For example, certain methods of contacting the article with the cleaning composition can be more efficient at cleaning certain materials as compared to other methods. In addition, the method of contacting the article can depend on the type of soils on the surface of the article.

Currently, cleaning compositions used in cleaning processes include organic solvents. The term "organic solvent" as used herein encompasses undiluted organic compounds as well as mixtures of two or more organic compounds which are generally designated in the art as organic solvents, and also mixtures of one or more such organic compounds with water. Organic solvents most often used in cleaning processes for industrial parts can include, hydrocarbons, halogenated hydrocarbons, glycol ethers, esters, or mixtures thereof.

Since organic solvents can have a low heat of vaporization as compared to water, one benefit of employing cleaning compositions including mostly organic solvents is that the cleaning compositions can be recycled within a cleaning process through distillation. In addition, cleaning compositions including organic solvents can dissolve soils that are likely to be on article surfaces, for example, nonpolar soils such as grease and oil. As such, the organic solvents generally used in cleaning processes similar to the cleaning process described herein, including those listed above, can show a very low polarity compared to water. However, the low polarity as compared to water of the organic solvents can limit the solubility and cleanability of very polar soils, for example, salt residues, fingerprints, and/or emulsion residues which are typical in metal working processes.

In prior art cleaning processes, in order to remove both nonpolar soils and polar soils, an aqueous cleaning step is used in addition to an organic solvent cleaning step, or in some instances a purely aqueous process can be used. Including an aqueous cleaning step, however, introduces several problems. First, the aqueous cleaning formulation includes water in addition to additives and contaminants once the aqueous cleaning step is performed. Such formulations are prohibitively expensive to recycle since distilling water is difficult due to the high heat of vaporization of aqueous cleaning formulations, as compared to organic solvents. In addition, the additives included in the aqueous cleaning formulations, for example, surfactants and/or corrosion inhibitors, typically have boiling points in the same range as the soils being cleaned from the surface of the article. As such, the additives in the aqueous cleaning formulations are difficult to recover using distillation. In addition, if no recycling unit (e.g., distillation apparatus) is used, aqueous cleaning formulations including the additives and contaminants require wastewater treatment before disposal of the aqueous cleaning formulations, which can also incur prohibitive expenses.

Embodiments of the present disclosure, however, include a cleaning process where the cleaning composition includes at least about 85 percent by weight organic solvents, based on total weight of the cleaning composition, where the organic solvents include at least 5 percent by weight propylene glycol, based on total weight of the organic solvents. Propylene glycol is a much more polar compound as compared to the organic solvents listed above (e.g., hydrocarbons, halogenated hydrocarbons, glycol ethers, esters), thus, including propylene glycol in the cleaning composition increases the polarity of the cleaning composition. By increasing the polarity of the cleaning composition, more polar soils can be more readily dissolved by the cleaning composition.

Usually the addition of a polar solvent, like water, to a less polar organic solvent, drastically reduces the oil solubility of the mixture. However, the addition of propylene glycol can drastically increase the cleaning efficiency for polar soils (e.g., artificial fingerprint residues) while keeping the oil solubility at a high level. For example, in some embodiments, the cleaning composition can solubilize oil when the oil in the cleaning composition is up to about 33 weight percent oil, based on total weight of the cleaning composition. In addition, the oil solubility can vary depending on the concentration of propylene glycol and the temperature of the cleaning composition, among other factors.

In some embodiments, the organic solvents in the cleaning composition can include propylene glycol in a range of about 5 percent by weight to about 99 percent by weight, based on the total weight of the organic solvents. In addition, in various embodiments, the organic solvents in the cleaning composition can include propylene glycol in a range of about 15 percent by weight to about 35 percent by weight, based on the total weight of the organic solvents.

In some embodiments, the organic solvents in the cleaning composition can include propylene glycol in an amount less than 20 percent by weight, based on the total weight of the organic solvents. In such embodiments, the cleaning method can further include applying a mechanical force to the article to clean the article. For example, the mechanical force applied can be ultrasonic vibrations. Other mechanical forces can also be applied, including, for example, stirring, movement of the articles (e.g., rotation of the basket), and/or high pressure liquid spraying, among others.

In some embodiments, the make-up of the cleaning composition can be determined by considering the nature of the soils. As such, the soils on the article surface can have a first polarity; in such embodiments, the cleaning process can include dissolving the soils on the article surface by adjusting the amount of propylene glycol included in the organic solvents of the cleaning composition to give the cleaning composition a similar polarity as the soils on the article surface. For example, in embodiments where the soils on the article surface are substantially all polar, the organic solvents in the cleaning composition can include up to 99 percent by weight propylene glycol, based on total weight of the organic solvents. In embodiments where the soils on the article surface have a mixture of polarities, the organic solvents in the cleaning composition can include propylene glycol in a range of about 15 to about 35 percent by weight, based on the total weight of the organic solvents. Other propylene glycol ranges are also possible.

In addition, the organic solvents in the cleaning composition can include at least one of propylene glycol ethers, ethylene glycol ethers, ethylene glycol ether acetates, propylene glycol ether acetates, esters, hydrocarbons, halogenated hydrocarbons, alcohols, or mixtures thereof. Also, in those embodiments where the cleaning composition contains water, the cleaning composition preferably contains less than 20 percent, more preferably less than 10 percent, and most preferably contains less than 5 percent water, based on the total weight of the cleaning composition.

In some embodiments, the cleaning composition can also include additional elements, including, but not limited to, organic and/or inorganic acids, organic bases and/or inorganic bases (e.g., for pH control), antioxidants, corrosion inhibitors, metal passivators, and/or staining inhibitors, among other additional elements.

As discussed herein, the method of cleaning the article includes collecting the cleaning composition including the contaminants from the surface of the article, and distilling the cleaning composition to recover and recycle the cleaning composition. As shown in FIG. 1, the cleaning machine 100 includes a conduit system equipped with valves connecting the cleaning chamber 102 to other equipment in the cleaning machine 100. In addition, as shown, inlet air 123 can be fed into the cleaning chamber 102, while waste gas 121 can be removed from the cleaning machine 100 by means of a vacuum pump 124.

The cleaning composition, including the soils, can be recovered by including a process stream 104 connected to the cleaning chamber 102. The cleaning composition including the soils can be transferred through the process stream 104 to one or more storage tanks 106, 108. The storage tanks 106, 108 can be connected to the cleaning chamber 102 in a known way. The cleaning process shown in FIG. 1 includes two storage tanks 106, 108, however, cleaning processes can include one storage tank, as well as more than two storage tanks.

The cleaning composition including the contaminants can then be transferred from the storage tanks 106, 108 back to the cleaning chamber via process streams 110 and 112, or the cleaning composition including the contaminants can be transported to a distillation apparatus 114 via process stream 116. In some embodiments, the cleaning composition including the contaminants can be transported to the distillation apparatus 114 continuously. In other words, process streams 110, 112 can be closed using valves 118, 120, forcing all the cleaning composition including the contaminants to flow to the distillation apparatus 114.

In addition, in various embodiments, the cleaning composition including the contaminants can be transported to the distillation apparatus semi-continuously. In such embodiments, process streams 110, 112 and also process stream 116 can be opened and closed periodically using valves to transfer the cleaning composition including the contaminants directly back to the cleaning chamber 102 and to the distillation apparatus 114 depending on which process streams are opened. In such embodiments, the periodicity of when the cleaning composition including contaminants is transferred to the distillation apparatus 114 can be based on a number of different factors. For example, the periodicity can be based on the type and amount of soils on the surface of the article, the method of contacting the article with the cleaning composition (e.g., fluid spraying), the type of article, and/or the level of cleanliness required for the article, among others.

In addition, in some embodiments, the distillation unit 114 can be operated semi-continuously by connecting the distillation unit 114 to the storage tanks 106, 108 directly. For example, the distilled cleaning composition can be transferred to the storage tank 106 via process stream 115 when valve 117 is closed, and valve 119 is opened. As such, the storage tanks 106, 108 can fill with distilled cleaning composition and can be transferred directly to the cleaning chamber via process streams 110, 112.

As used herein, "distilling" refer to a process of separating compounds based on their differences in volatilities by vaporization and subsequent condensation, as for purification or concentration. In embodiments discussed herein, distillation can be performed on the cleaning composition to purify the cleaning composition. In addition, as used herein, a "distillation apparatus" refers to a device that carries out the distillation process.

The distillation apparatus 114 of the present disclosure can include enough equilibrium stages to remove the soils from the cleaning composition. As used herein, an "equilibrium stage" can refer to a hypothetical zone or stage in which two phases, such as the liquid and vapor phases of a substance, establish equilibrium with each other. The equilibrium stage can also be referred to as a theoretical tray.

The distillation apparatus 114 of the present disclosure can have trays, dumped packing, or structured packing. In embodiments where the distillation apparatus 114 has trays, the trays can be physical devices which are used to provide contact between an upflowing vapor and a downflowing liquid inside the distillation apparatus 114.

In some embodiments, the distillation apparatus 114 can use packing rather than trays. In some embodiments, packing can offer the advantage of a lower pressure drop across the distillation apparatus 114 (when compared to trays). In embodiments using packing, the packing material can be random dumped packing such as, for example, Raschig rings, Pall rings, or Bialecki rings in metal or ceramic. The packing material can also be structured sheet-metal packing such as those known and commercially available for example under the designations Gempak® (Glitsch, Inc. Dallas, Tex., U.S.A), Mellapak® (Gebr. Sulzer, Winterthur, Switzerland), or Relapak®.

In some embodiments, the distillation apparatus 114 can be operated under vacuum. Since the boiling point of the organic solvent is lowered at lower pressure, the temperature in the distillation bottom can be lowered when the distillation apparatus 114 is operated under vacuum. The lower temperature can be used to minimize the formation of unwanted products by, for example, thermal decomposition reactions. Also, the organic solvent content of the waste stream from the distillation bottom can be minimized, which leads to lower organic solvent consumption.

Distilling the cleaning composition including the contaminants in the distillation apparatus 114 removes the contaminants from the cleaning composition. Thus, the cleaning composition can be recycled back to the cleaning chamber 102 via process stream 122. In addition, in some embodiments, additional cleaning composition can be transferred to the closed chamber 102 from a storage tank 126 containing unused, unrecycled cleaning composition.

As appreciated by one skilled in the art, the cleaning composition including contaminants can be distilled by the distillation apparatus 114 to produce purified cleaning composition to be used to clean the article inside the cleaning chamber 102 continuously while the article is being cleaned. Since the cleaning composition is being recovered and recycled throughout the cleaning machine 100, the cleaning machine operates in a closed loop. In other words, in some embodiments, the cleaning process can continue without the addition of new, unused cleaning composition.

As appreciated by one skilled in the art, once the article is cleaned, the cleaned articles can be dried, and the cleaning chamber 102 can be unloaded.

It is to be understood that the above description has been made in an illustrative fashion, and not a restrictive one. Although specific embodiments have been illustrated and described herein, those of ordinary skill in the art will appreciate that other component arrangements can be substituted for the specific embodiments shown. The claims are intended to cover such adaptations or variations of various embodiments of the disclosure, except to the extent limited by the prior art.

In the foregoing description, various features are grouped together in exemplary embodiments for the purpose of streamlining the disclosure. This method of disclosure is not to be interpreted as reflecting an intention that any claim requires more features than are expressly recited in the claim. Rather, as the following claims reflect, inventive subject matter lies in less than all features of a single disclosed embodiment. Thus, the following claims are hereby incorporated into the description, with each claim standing on its own as a separate embodiment of the invention.

Embodiments of the present disclosure are illustrated by the following examples. It is to be understood that the particular examples, materials, amounts, and procedures are to be interpreted broadly in accordance with the scope and spirit of the invention as set forth herein.

EXAMPLES

The following examples are given to illustrate, but not limit, the scope of this disclosure. Unless otherwise indicated, all parts and percentages are by weight. Unless otherwise specified, all instruments and chemicals used are commercially available.

Materials

Sodium Chloride (NaCl): available from Sigma Aldrich Corp. (St. Louis, Mo., USA).

Urea: available from Sigma Aldrich.

Lactic acid: available from Sigma Aldrich.

DOWANOL PnB: propylene glycol mono n-butyl ether (available from The Dow Chemical Company, Midland, Mich., USA).

DOWANOL DPM: dipropylene glycol mono methyl ether (available from The Dow Chemical Company, Midland, Mich., USA).

Proglyde DMM: dipropylene glycol dimethyl ether (available from The Dow Chemical Company, Midland, Mich., USA).

Propylene Glycol: available from The Dow Chemical Company, Midland, Mich., USA.

DOWCLENE 1601: available from The Dow Chemical Company, Midland, Mich., USA.

DOWCLENE 1611: available from The Dow Chemical Company, Midland, Mich., USA.

MAXIBOOST ST-1: available from The Dow Chemical Company, Midland, Mich., USA.

Example 1

In this example, a pattern of 10 well defined drops of 40 microliters (μl) synthetic fingerprint solution consisting of 0.9 percent NaCl, 0.4 percent Urea, and adjusted to a pH of 4.5 with lactic acid are applied to a stainless steel specimen (about 3 centimeters (cm)×10 cm, pre-cleaned with water, acetone, and methylene chloride) by means of a 20 μl pipette. The fingerprint drops are then evaporated with a heated plate at a temperature of about 130 degrees Celsius (° C.). The specimens are removed once the solution is completely dried.

The prepared specimens are then immersed in the cleaning solutions for a certain period of time at a defined temperature. The cleaning results are evaluated visually after drying the specimens with pressurized air.

As used herein, the term, "undercut" refers to instances where the synthetic fingerprint forms flakes that fall off of the stainless steel specimen, but do not dissolve in the cleaning solutions. In addition, as used herein, the term "dissolve" refers to instances where the synthetic fingerprint dissolves completely in the cleaning solution.

Table 1 provides the solubility of the finger print solutions using different cleaning compositions.

TABLE 1

| Trial | Cleaning Composition | Temp. (° C.) | Cleaning Result after 5 min |
|---|---|---|---|
| Control | DOWCLENE ™ 1601, 2.5% MAXIBOOST ™ ST-1 | 60 | Fingerprints not dissolved nor undercut, no improvement by ultrasonic |
| 1 | 20% propylene glycol in DOWCLENE ™ 1611 | 60 | slightly attacked residues with 30 seconds of ultrasonic |
| 2 | 30% propylene glycol in DOWCLENE ™ 1611 | 60 | slightly attacked, still some residues with 30 seconds of ultrasonic |

As can be seen from Table 1, the control cleaning composition shows no effect on the fingerprints applied to the stainless steel specimens. However, in Trials 1 and 2, when propylene glycol is added to DOWCLENE 1611, the fingerprints are partially removed, but not completely. From this, adding propylene glycol to the cleaning composition is shown to be a solubilizing agent for a polar residue (e.g., fingerprint), while also showing that the fingerprints are not removed by an undercutting action.

Table 2 shows the results for cleaning a fingerprint, prepared as described above, while adding various amounts of propylene glycol to DOWCLENE 1611 for the cleaning composition as time progresses. The cleaning is carried out at 80° C. without the use of ultrasonic vibrations. The solubility of the fingerprints are determined visually.

TABLE 2

| Time (minutes) | 20% propylene glycol in DOWCLENE 1611 | 30% propylene glycol in DOWCLENE 1611 | 50% propylene glycol in DOWCLENE 1611 |
|---|---|---|---|
| 1 | not clean | not clean | best performance, not clean yet |
| 3 | not clean | not clean | clean, no residues |
| 15 | not clean | not clean, slightly better than 20% | |

As can be seen from Table 2, increasing the concentration of propylene glycol improves the cleaning performance for the synthetic fingerprint residues.

Table 3 shows the results for cleaning fingerprints applied to a stainless steel specimen, as described above, when the organic solvent is varied. In addition, the results are shown for instances where ultrasonic is applied and where ultrasonic is not applied. In those trials where ultrasonic is applied, the ultrasonic vibrations are applied for the entire immersion time.

TABLE 3

| Trial | Base solvent DOWCLENE | % propylene glycol | Temp. (° C.) | time (min) | Ultra-sonic Applied? | Results |
|---|---|---|---|---|---|---|
| 3 | 1611 | 25 | 75 | 53 | no | clean |
| 4 | 1601 | 25 | 75 | 64 | no | some residues |
| 5 | 1611 | 25 | 75 | 0.33 | yes | approx. 50% of the spots removed |
| 6 | 1601 | 25 | 75 | 0.33 | yes | approx. 50% of the spots removed |
| 7 | 1611 | 25 | 75 | 0.67 | yes | clean |
| 8 | 1601 | 25 | 75 | 0.67 | yes | clean |

As shown in Table 3, Trials 3 and 4 illustrate that DOWCLENE 1611 cleans the fingerprints from the stainless steel specimens more readily than DOWCLENE 1601 when using the same concentration of propylene glycol, and when no mechanical force is applied. Trials 5-8 illustrate that the differences between DOWCLENE 1611 and DOWCLENE 1601 are negligible when mechanical force is applied.

Example 2

In this example, the solubility of a commercial oil sample (Shell Ensis L) is shown by titrating 67.5 grams (g) of a mixture of oil and organic solvent with propylene glycol using 1 milliliter (ml) increments. The concentration at which clouding of the mixture occurs is determined visually. The organic solvents are DOWANOL PnB and DOWANOL DPM. Results from the titration show that the oil solubility for DOWANOL PnB-based mixtures is significantly higher than for DOWANOL DPM.

From the titrations, 35 percent propylene glycol in DOWANOL PnB has an oil solubility of 14 percent at 61° C. At 66° C., a 27 percent propylene glycol/73 percent DOWANOL PnB mixture solubilizes oil when the oil concentration rises up to about 33 percent. On the other hand, when the concentration of oil in pure DOWANOL DPM is about 20 percent, the oil does not dissolve, the formulation gives two phases at room temperature, and the formulation gives a homogenous, cloudy mixture that remains cloudy up to 77° C. In addition, for the pure DOWANOL DPM, lowering the oil concentration to 10 percent does not yield a clear solution.

From this, it is clear that adding propylene glycol to an organic solvent can enhance the solubility of oil in the cleaning composition.

Example 3

In this example, the solubilities of residues of sodium chloride and sodium sulfate in various mixtures of propylene glycol and propylene glycol ethers are determined by gravimetry. For example, salt is added to 100 g of the respective cleaning composition and left standing at room temperature for 24 hours. The liquid is then filtered from the undissolved salt crystals and the filtrate is evaporated in a beaker at 80° C. for 3 days. The solubility of the residues of NaCl are presented in Table 4, the solubility of the residues of $Na_2SO_4$ are presented in Table 5.

TABLE 4

| Cleaning Composition | Mass Ratio | Solubility |
|---|---|---|
| Propylene Glycol | 100 | 0.425 |
| Dowanol DPM | 100 | 0.020 |
| Dowanol PnB | 100 | 0.002 |
| Propylene Glycol/Dowanol DPM | 75/25 | 0.387 |
| Propylene Glycol/Dowanol DPM | 50/50 | 0.270 |
| Propylene Glycol/Dowanol DPM | 25/75 | 0.125 |
| Propylene Glycol/Dowanol PnB | 75/25 | 0.410 |
| Propylene Glycol/Dowanol PnB | 50/50 | 0.137 |
| Propylene Glycol/Dowanol PnB | 25/75 | 0.043 |

TABLE 5

| Cleaning Composition | Mass Ratio | Solubility |
|---|---|---|
| Propylene Glycol | 100 | 0.016 |
| Dowanol DPM | 100 | 0.008 |
| Dowanol PnB | 100 | 0.002 |
| Propylene Glycol/Dowanol DPM | 75/25 | 0.009 |
| Propylene Glycol/Dowanol DPM | 50/50 | 0.004 |
| Propylene Glycol/Dowanol DPM | 25/75 | 0.005 |
| Propylene Glycol/Dowanol PnB | 75/25 | 0.007 |
| Propylene Glycol/Dowanol PnB | 50/50 | 0.003 |
| Propylene Glycol/Dowanol PnB | 25/75 | 0.002 |

As can be seen from Tables 4 and 5, the highest solubility for both residues are when propylene glycol is the cleaning composition. In addition, for each composition including a mixture of propylene glycol and organic solvent, the cleaning compositions including 75 percent propylene glycol dissolves the residues most readily.

What is claimed:

1. A closed loop cleaning process, comprising:

loading an article to be cleaned into a cleaning chamber;

closing the cleaning chamber;

vaporizing a non-aqueous cleaning composition into a non-aqueous cleaning composition vapor, where the non-aqueous cleaning composition includes at least about 85 percent by weight organic solvents, based on total weight of the non-aqueous cleaning composition, and where at least about 5 percent by weight of the organic solvents is propylene glycol, based on total weight of the organic solvents;

directing the non-aqueous cleaning composition vapor into the cleaning chamber;

condensing the non-aqueous cleaning composition vapor into a liquid on a surface of the article, to clean the surface of the article;

collecting the non-aqueous cleaning composition including contaminants from the article;

recovering the non-aqueous cleaning composition via distillation from contaminants in the non-aqueous cleaning composition, where a distillation apparatus removes the contaminants from the non-aqueous cleaning composition; and recycling, by a process stream in the closed loop cleaning process, the non-aqueous cleaning composition recovered via distillation back to the closed cleaning chamber.

2. The closed loop cleaning process of claim 1, including flowing the recycled non-aqueous cleaning composition to a storage tank connected to the cleaning chamber.

3. The closed loop cleaning process of claim 1, where the organic solvents in the non-aqueous cleaning composition include propylene glycol in a range of about 5 percent by weight to about 99 percent by weight, based on total weight of the organic solvents.

4. The closed loop cleaning process of claim 1, where the organic solvents in the non-aqueous cleaning composition include propylene glycol in a range of about 15 percent by weight to about 35 percent by weight, based on total weight of the organic solvents.

5. A method of cleaning an article in a closed loop cleaning machine, comprising:

loading the article including soils on an article surface, where the soils are to be removed, into a cleaning chamber;

closing the cleaning chamber;

vaporizing a non-aqueous cleaning composition into a non-aqueous cleaning composition vapor, where the non-aqueous cleaning composition includes at least about 85 percent by weight organic solvents, based on total weight of the non-aqueous cleaning composition, and where at least about 5 percent by weight of the organic solvents is propylene glycol, based on total weight of the organic solvents;

directing the non-aqueous cleaning composition vapor into the cleaning chamber;

condensing the non-aqueous cleaning composition vapor into a liquid on the article surface to remove the soils;

collecting the non-aqueous cleaning composition including the soils from the article;

distilling the non-aqueous cleaning composition, including the soils, to separate the non-aqueous cleaning composition from the soils; and recycling, by a process stream in the closed loop cleaning process, the non-aqueous cleaning composition recovered via distillation back to the closed cleaning chamber.

6. The method of claim 5, where the soils on the article surface have a polarity and the non-aqueous cleaning composition has a polarity, and where the method includes dissolving the soils on the article surface by adjusting the amount of propylene glycol included in the organic solvents of the non-aqueous cleaning composition up to 99 percent by weight based on the total weight of the organic solvents.

* * * * *